United States Patent [19]

Richardson et al.

[11] 4,117,935

[45] Oct. 3, 1978

[54] APPARATUS FOR AND METHOD OF MEASURING PRODUCT MASS

[75] Inventors: Carl Richardson, Bedford; Hugh F. Stoddart, Groton; Philip A. Wiley, Boxboro, all of Mass.

[73] Assignee: Bedford Engineering Corp., Bedford, Mass.

[21] Appl. No.: 694,240

[22] Filed: Jun. 9, 1976

[51] Int. Cl.[2] ..... B07C 5/16; B07C 5/344

[52] U.S. Cl. ..... 209/586; 209/592; 250/272; 250/273

[58] Field of Search ..... 209/111.5, 121; 250/272, 273, 277, 278, 279, 358, 359, 360, 308

[56] References Cited

U.S. PATENT DOCUMENTS

| | | | |
|---|---|---|---|
| 3,361,911 | 1/1968 | Kowalczynski | 250/358 X |
| 3,629,586 | 12/1971 | Giles | 250/359 |
| 3,662,882 | 5/1972 | Obermayer | 209/111.5 |
| 3,708,064 | 1/1973 | Schepler et al. | 250/360 X |
| 3,729,632 | 4/1973 | Cho et al. | 250/278 |
| 3,919,548 | 11/1975 | Porter | 250/277 |
| 3,982,125 | 9/1976 | Roder | 250/272 |

*Primary Examiner*—Robert B. Reeves
*Assistant Examiner*—Joseph J. Rolla
*Attorney, Agent, or Firm*—Schiller & Pandiscio

[57] ABSTRACT

A novel apparatus for and method of measuring product mass is described in which products are sequentially conveyed to an inspection station where the entire bulk of each product is substantially instantaneously irradiated with a beam of radiation. Scattered radiation from the product thus irradiated is detected to provide an electrical signal whose magnitude is representative of the mass of the product. The products can be sorted in accordance with their measured mass.

24 Claims, 6 Drawing Figures

APPARATUS FOR AND METHOD OF MEASURING PRODUCT MASS

This invention relates to the classification of products in accordance with their mass and more particularly to the measurement of product masses by scattered radiation analysis and the sorting of such products in accordance with these measurements.

Various systems are known for measuring the amount of material present in a container of a particular product which is massed produced. One type of system which determines the amount of material by measuring its volume includes a source of electromagnetic radiation for providing a beam which is caused to scan a product from one end to the other, and a detector which is sensitive to the back-scattered radiation received from the scanned product. The magnitude of the back-scattered radiation recieved by the detector is proportional to the density of the particular area of the container to which the scanning beam is directed; and thus, for example, when using such a system to measure the volumetric amount of powder in cartridges, if a cartridge being measured is full of powder, the measured back-scatter radiation will remain approximately the same as the entire cartridge is scanned. If, however, the cartridge is only partially full of powder, as the beam scans the cartridge from an area below the level of the powder to above the level of the powder, the density will change and thus the amount of detected back-scattered radiation will change.

In many instances, however, it is preferred to measure the mass of the contents of such products. For example, in the manufacture of pharmaceutical products in the form of capsules, tablets and pills, it is important that the mass or weight content of each product be within prescribed limits, since many such products are prescribed in accordance with their mass and not their volumetric content. Even though a tablet may be compacted with a binder to form a uniformly-sized product or a capsule may be full, the mass may vary widely depending on how tightly the drug is packed.

It is an object of the present invention therefore to provide a method of and apparatus for classifying products according to their mass.

It is another object of the present invention to provide a method of and apparatus for separately measuring products in accordance with their mass and sorting each product in accordance with the measurement.

Still another object of the present invention is to provide a method of and apparatus for classifying and sorting products quickly and automatically.

These and other objects are achieved by a system and method of classifying products according to their mass wherein and whereby the products are conveyed along a predetermined path through an inspection station where a beam of radiation, directed transversely to the predetermined path, intercepts and penetrates each product individually. The entire bulk of each product in the inspecting station is exposed to the beam at one time. Scattered radiation from the product irradiated in this manner is detected and converted to an electrical signal which is representative of the mass of the measured product. The products can then each be sorted according to their measured mass.

Other features and many of the attendant advantages of the invention are disclosed in or rendered obvious by the following detailed description which is to be considered together with the accompanying drawings in which.

In the drawings, like numerals refer to like parts.

Figure 2:
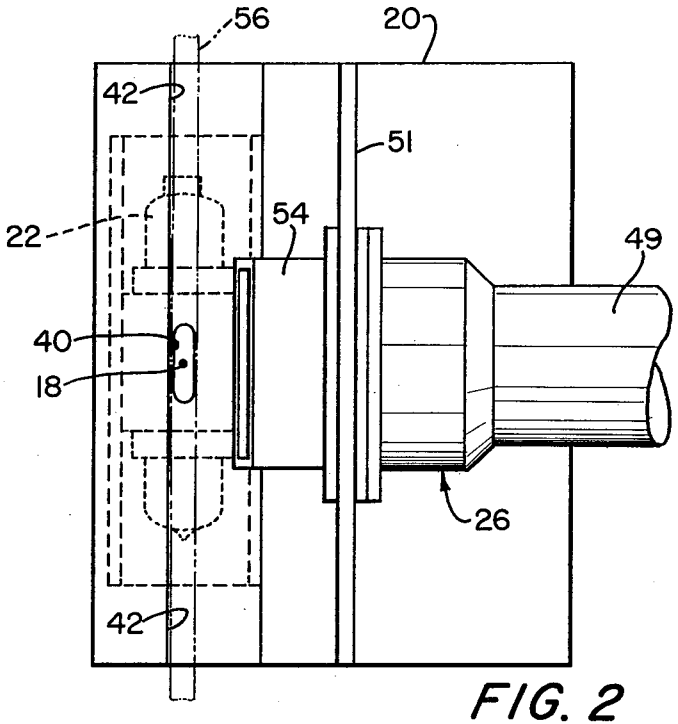
FIG. 2 shows a side view of the apparatus of FIG. 1.
Figure 1:
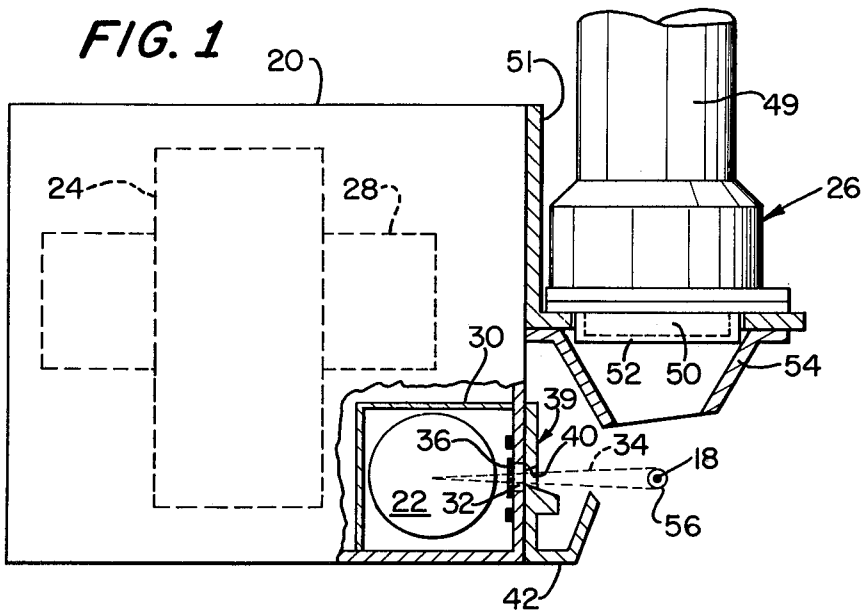
FIG. 1 shows a top view partly in section of a portion of a preferred embodiment of the present invention.

FIGS. 1 and 2 illustrate the apparatus forming part of a system constructed in accordance with the present invention for measuring the mass of a product positioned at a selected point 18. The apparatus shown in FIG. 1 comprises a housing 20 for supporting a source 22 of electro-magnetic radiation, a power supply 23 (shown in blockform in FIG. 6) for operating pulse transformer 24 (shown in phantom in FIG. 1) for energizing the source 22 and a radiation detector 26. Housing 20 includes a supporting structure 28 for supporting transformer 24, a chamber 30 in which is supported source 22, and an aperture 32 which is positioned so as to allow a beam 34 of radiation emitted by source 22 to pass out from chamber 30 to point 18. Housing 20 is made of aluminum or other suitable material and lined with lead or a similar material or alloy which is opaque to radiation emitted by source 22. The latter is preferably any one of several devices for producing low-energy X-rays or low energy gamma radiation, such as an X-ray tube (as illustrated for example in McGraw-Hill Encyclopedia of Science and Technology, McGraw-Hill Book Company Inc. (1960), Volume 14, pp. 587–590) or a container filled with Americium 241, Gadolinium 143 or Cobalt 57. In the preferred embodiment source 22 is an X-ray tube which is turned on selectively for a predetermined amount of time in order to irradiate the product at point 18 with a predetermined amount of radiation. However, source 22 can also be of a type which radiates a beam 34 continuously, with the capsule moving into the path of the beam at point 18 for a predetermined period of time. As is well known in the art, chamber 30 can be filled with oil in order to prevent overheating of source 22. A thin wall window 36, transparent to beam 34 and impermeable to the oil, is positioned over aperture 32 so as to prevent oil leakage. One suitable material for the window is black nylon although other materials will be obvious to those skilled in the art.

The front of housing 20 is provided with a baffle and collimator assembly which includes a plate 39 having a slit 40 and a baffle 42. Slit 40 is aligned with aperture 32 and is contoured to shape beam 34 so that the latter substantially conforms to the shape of and illuminates the entire product positioned at or passing through point 18. Plate 39 and baffle 42 are opaque to the radiation of beam 34. Hence, any radiation emitted through aperture 32 and slit 40 and directed toward the baffle is blocked by the latter. For reasons which will become more evident hereinafter, the baffle is preferably positioned to one side of the slit 40, opposite the radiation detector 26.

Detector 26 is positioned so as to measure radiation scattered by the product positioned at or passing through point 18, when the product is irradiated by beam 34. Detector 26 preferably is located as close as possible to housing 20 so as to provide a compact structure. However, the particular angular position of the detector 26 relative to the source 22 is not critical to the measurement of the mass of the product since side scattering of radiation occurs over a wide angle. In the preferred embodiment, detector 26 is positioned so that its axis is at an angle of approximately 90° to the direction of beam 34, since the size of housing 20 is relatively large and thus detector 26 is more easily placed to the side of the source 22. Detector 26 is sensitive to the radiation scattered by the product at point 18 and converts the radiation received into an electrical current or voltage signal. The magnitude of this signal is a function of the amount of scattered radiation received which in turn is a function of the mass of the product irradiated. Detector 26 may be any one of various devices, preferably operable in a current mode, such as a scintillation counter or an ionization detector, depending upon the nature of the radiation emitted by source 22. Preferably, detector 26 includes a photomultiplier tube 49 which is mounted directly to housing 20 by means of a bracket 51, and a sodium iodide scintillation crystal 50 which is mounted to the photo-multiplier tube behind a window 52. The latter is made of a material which is transparent to the scattered radiation received from the product at point 18. Preferably window 52 is made of black nylon or other similar material. Attached to bracket 51 is a collimator assembly 54 which is made of a material such as lead which will not excite or amplify the scattered radiation received from point 18. Collimator 54 is shaped and positioned so as to pass scattered radiation from point 18 and also so as to prevent any of the radiation of beam 34 from passing directly to scintillation crystal 50.

In accordance with the present invention beam 34 floods a product positioned at point 18 so that the entire bulk of the product is substantially instantaneously exposed to the beam. The detector 26 receives radiation scattered by the product when the latter is irradiated by beam 34 and generates an electrical signal representative of the quantity of scattered radiation which it receives. By properly processing and evaluating this electrical signal the mass of the product can be easily calculated regardless of its density.

Figure 5:
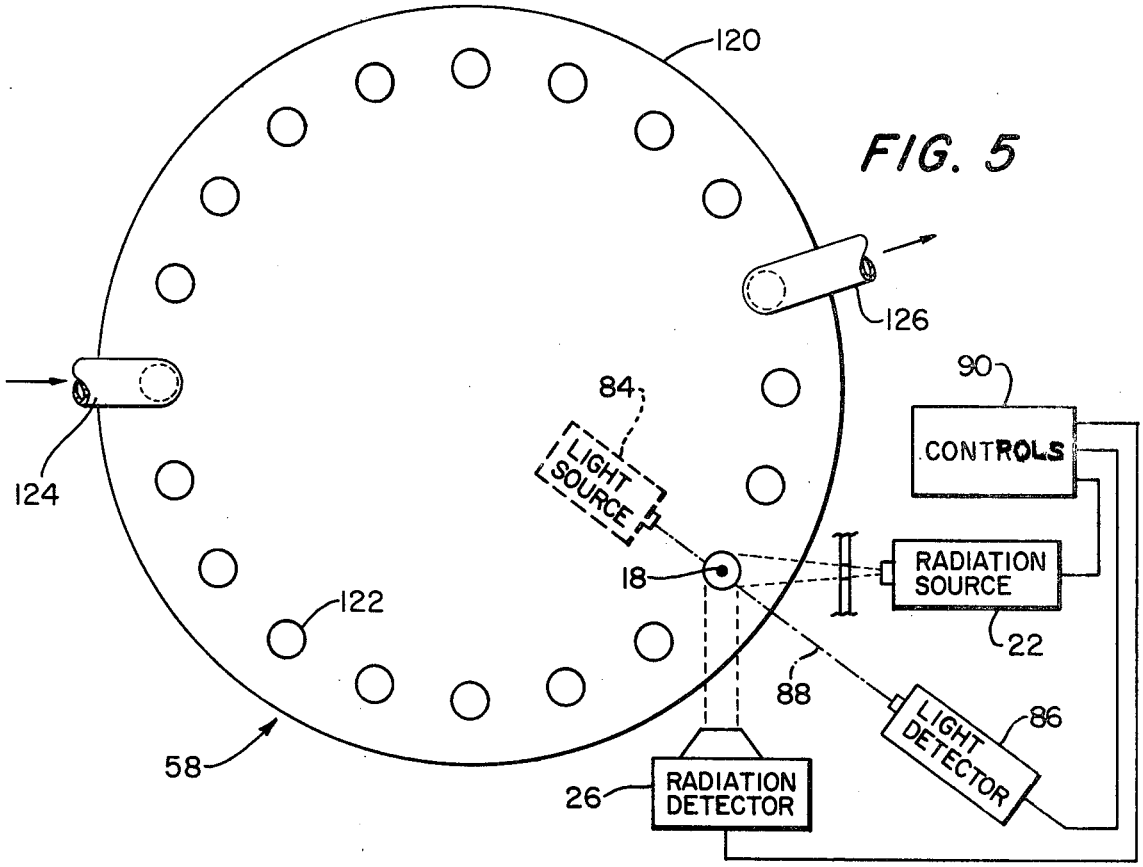
FIG. 5 illustrates a top schematic view of a second form of product conveying and sorting system useful with the apparatus of FIG. 1.

Various systems, such as a transport tube assembly 56, partially shown in phantom in FIG. 2, or a carousel 58 shown in FIG. 5, may be provided for conveying products sequentially to point 18. Further, means may be used for sorting the products in accordance with their measured mass.

Figures 3, 4:
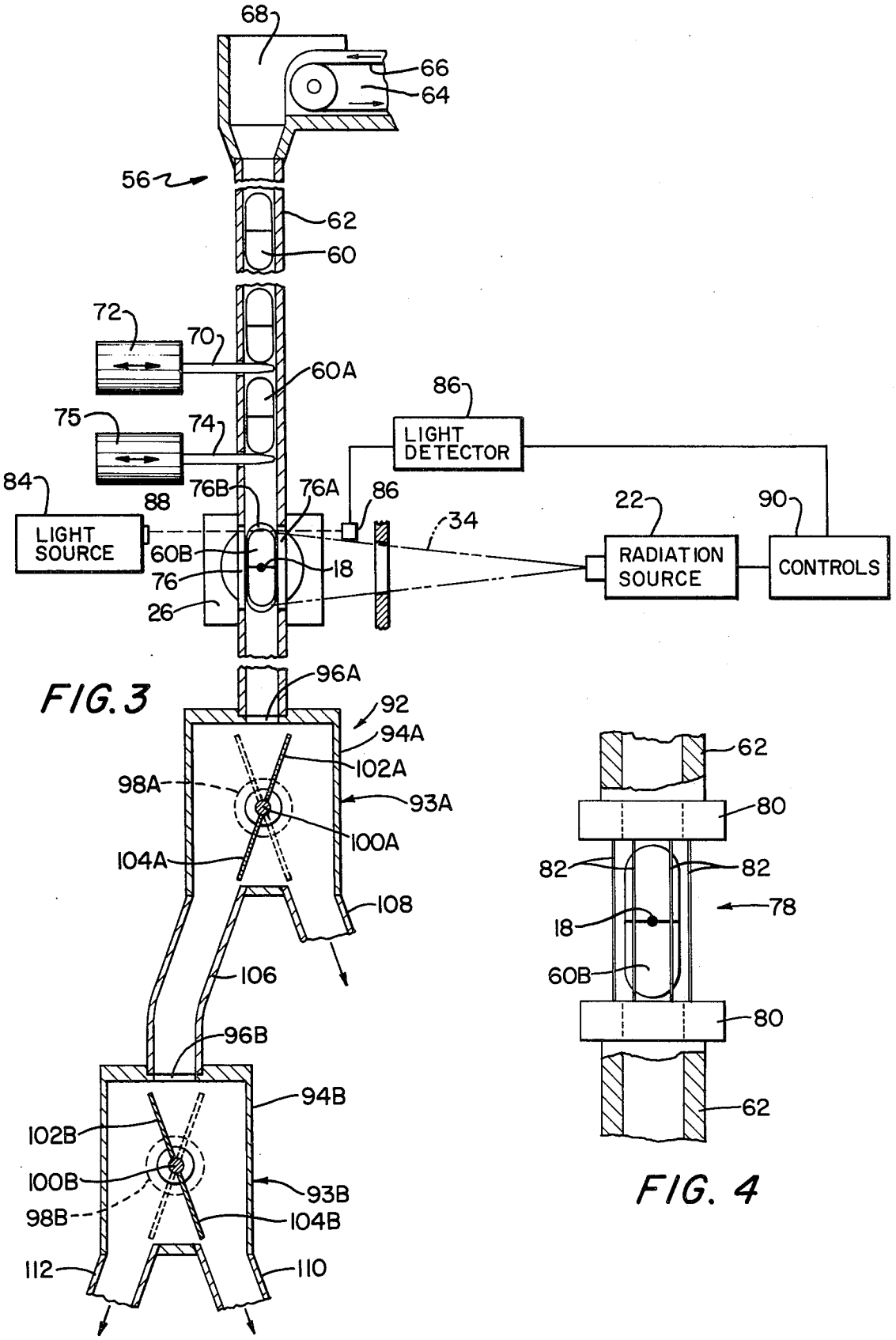
FIG. 3 illustrates a partially sectional, partially schematic side view of a form of product conveying and sorting system useful with the apparatus of FIG. 1.
FIG. 4 is a side elevation, partly in section, of a modification of the "viewing window" of the product conveying and sorting system of FIG. 3.

The transport tube system 56, which has particular utility for measuring the mass of medicinal products such as capsules and pills, is shown in greater detail in FIG. 3. The products, here shown in the form of capsules 60, are fed individually into an elongated tube 62 by a suitable feeding mechanism 64. Tube 62 is located so that each capsule fed into it will fall by gravity through the point 18. The internal diameter of tube 62 is preferably slightly larger than the outer diameter of capsules 60 so that the latter will fall freely in tube 62 while preventing the passage therethrough of more than one capsule at a time.

Feeding mechanism 64 may be any type of feed mechanism known in the art which will feed capsules 60 sequentially into the tube 62. One such feed mechanism is shown and described in U.S. Pat. No. 3,399,756 issued Sept. 3, 1968, to Michael Klapes for Counting Machine with Adjustable Article Channeling Mechanism. The feed mechanism described therein includes a vibratory feeder assembly which is adapted to receive batches of the capsules 60. The assembly vibrates causing the capsules to travel along a helical ramp to a channeling and conveyor belt 66 which in turn conveys each capsule along, to the upper funnel-shaped open end 68 of tube 62.

In a feed mechanism such as shown by Klapes, capsules are fed one at a time by the conveyor belt and the capsules are automatically spaced one from the other as they fall through the tube 62. The spacing between capsules may be varied by adjusting the conveyor belt speed relative to the speed at which capsules are fed by the vibrator bowl assembly. Only a minimum spacing between capsules is required to permit them to be irradiated fully one at a time without overlap and so that the output of the detector can be discriminated to distinguish the signal from one capsule from the signals of the capsules which were irradiated just before and just after it. However, a greater spacing between capsules mauy be required in order to effectively sort out the capsules according to their measured masses. The correct spacing may be attained by normal operation of mechanism which introduces the capsules into tube 62. However, the correct spacing may be difficult to attain by adjustment of the feed mechanism. In such event, additional means may be provided to assure that the capsules pass through the measuring point 18 and on to the sorting station at suitable intervals. Such spacing means are well known in the art and, for example, may be similar to the spacing mechanism shown and described in U.S. Pat. No. 2,632,553 issued Mar. 24, 1953 to Stirn et al. Thus, as described in the Stirn et al patent a spacing mechanism may be used which includes a first finger 70 which is secured in clamp 72 and a second finger 74 which is secured in clamp 75. Fingers 70 and 74 extend through openings in the wall of tube 62 transversely to the path of the falling capsules 60 and are adapted to separately move in and out of the path by the action of two rotating cams (not shown). Fingers 70 and 74 are spaced from one another just enough to allow one capsule to be positioned therebetween. In accordance with the teachings of U.S. Pat. No. 2,632,553, the operation of the spacing mechanism is as follows. Initially, both fingers 70 and 74 extend into the tube 62 to block the capsules 60. Finger 70 is first withdrawn so that a capsule 60A drops into contact with the second finger 74. Finger 70 is then moved back into the tube 62 so that it is positioned between capsule 60A and the other capsules positioned thereabove. The second finger 74 is then withdrawn from the tube 62 so that capsule 60A will fall through point 18. When capsule 60A is released, finger 70 will prevent the other capsules from also being released. Once capsule 60A is released, finger 74 is then moved back into the tube 62 and then finger 70 is withdrawn to drop another capsule. The process can be repeated at a predetermined repition rate.

Alternatively, the spacing means can comprise two sets of air jets (not illustrated) each set consisting of several (preferably three) air jets that are directed into tube 62 through suitable holes located at the corresponding levels where the fingers 70 and 74 are shown as extending into the tube. The air jets form a "curtain" of air within the tube to interrupt and hold capsules in the positions shown in FIG. 3. Proper spacing of the capsules is accomplished by having the two sets of air jets turned off and on in the same manner of the fingers 70 and 74 are alternately withdrawn from and reinserted into the tube 62.

The tube 62 is provided with a "viewing window" comprising at least two apertures 76 dimensioned so that they are larger than the outside dimensions of each capsule 60. One aperture 76A is aligned with aperture 32 and is sized and shaped so that as each capsule 60 moves past aperture 76A, the beam 34 will irradiate the entire bulk of the capsule 60. Another aperture 76B is provided which is aligned with the axis of detector 26 and is sized and shaped so that radiation scattered by the entire bulk of a capsule which is flooded by beam 34 will be received by the detector. In order to further reduce the mass of tube 62 which is exposed to beam 34, the tube is preferably provided with additional apertures 76 circumferentially spaced with respect to apertures 76A and 76B.

In an alternative embodiment, shown in FIG. 4, the portion of tube 62 is provided with apertures 76 and exposed to beam 34, is replaced with a viewing window 78 which is constructed to further reduce the amount of environmental mass exposed to beam 34. Window 78 comprises a collar 80 at each end for attaching the window to adjacent sections of tube 62. A plurality of wires 82 are secured at each of their ends to the collars 80 and oriented and spaced apart so as to maximize the amount of radiation of beam 34 which passes directly to the capsule located at point 18, while preventing the capsule from falling out between the wires.

Still referring to FIG. 3, a detector system is provided for determining when a capsule is positioned at point 18. This system comprises a light source 84 and a light detector 86 disposed at opposite sides of tube 62 in alignment with apertures 76A and B. The detector operates in a manner well known to those skilled in the art; light source 84 directs a light beam 88 through the apertures 76A and B to light detector 86. When a capsule falling in the tube 62 interrupts beam 88, light detector 86 provides a signal to a control circuit 90 which in turn triggers the operation of X-ray tube 22.

Each capsule which passes through point 18 and is measured, preferably falls into a sorting system, such as the diverter-type system referred to generally at 92. Diverter-type sorting systems are well known in the art. See, for example, U.S. Pat. Re. No. 25013 issued July 15, 1961 to Cleaveland et al.

In this illustrated embodiment of the invention, diverter system 92 includes first and second flow diverters 93A and 93B. The first flow diverter comprises a small substantially rectangular casing 94A having an aperture 96A at its top which is attached to and communicates with the bottom of tube 62. A rotary solenoid 98A is mounted on one side of casing 94A. The solenoid has an output shaft coupled by suitable connecting means (not known) to a shaft 100A which is rotatably supported by and extends between two opposite side walls of casing 94A. Shaft 100A carries two radially-disposed, oppositely-extending blades 102A and 104A. The combination of shaft 100A and blades 102A and 104A may be termed a shutter or gate. When the solenoid is deenergized, shaft 100A and blades 102A and 104A are oriented in a first position (shown in solid lines in FIG. 3) wherein they function to divert capsules falling out from tube 62 into a first tube 106 positioned below and attached to the casing 94A. When solenoid 98A is energized, shaft 100A and blades 102A and 104A are rotated, to a second position (shown in dotted lines in FIG. 3) wherein they cause a capsule falling out of tube 62 to be diverted into a second tube 108 which also is positioned below and attached to casing 94A. The solenoid is of a type which contains a spring which biases it to maintain shaft 100 and blades 102A and 104A in the position shown in solid lines when the solenoid is deenergized. The bottom of tube 106 is suitably connected to the second flow diverter 93B. The second flow diverter 93B is identical to the flow diverter 93A, and thus includes a casing 94B which is provided with an upper aperture 96B attached to and communicating with tube 106, a rotary solenoid 98B, mounted at one side of the casing 94B and having an output shaft coupled by suitable connecting means to the shaft 100B carrying two radially-extending blades 102B and 104B mounted in diametrical relation with respect to one another. The combination of shaft 100B and blades 102B and 104B function to divert capsules passing through tube 106 to one or the other of two tubes 110 and 112 which are connected to and communicate with the bottom of casing 94B. Normally, blades 102B and 104B are biased in a first position (shown in solid lines in FIG. 3) for diverting a capsule from tube 106 to tube 110. When, however, solenoid 98B is energized, the blades 102B and 104B are rotated to a second position (shown in dotted lines in FIG. 3) for diverting a capsule falling from the tube 106 to tube 112. In a typical installation, tubes 108, 110 and 112 may communicate with separate bins (not shown) so that the capsules may be collected in three separate groups as follows: (1) capsules whose mass is within some predetermined range, (2) capsules whose mass is below the predetermined range, and (3) those capsules whose mass is above the predetermined range.

In operation, the capsules 60 are sequentially fed by the feeding mechanism 64 into the open end 68 of the elongated tube 62 and fall by gravity (with or without use of auxiliary spacing fingers 70 and 74) past the apertures 76A and B, thereby reaching light beam 88. This provides an output from the light detector 86 to the controls 90, which in turn causes source 22 to generate radiation beam 34 which substantially instantaneously irradiates the entire bulk of the capsule 60B as it passes through the point 18. Scattered radiation from the capsule 60B is measured by detector 26 which provides a signal, the magnitude of which is dependent on the mass of the product 60B measured. This electrical signal is processed by an electronic circuit which forms part of the controls 90 and is described in greater detail with reference to FIG. 7. The electronic signal is processed so that if the mass of the measured capsule 60B is within a predetermined range, blades 102A and 104A and blades 102B and 104B will remain in their normal first position, whereby the capsule will travel from tube 62 via tube 106 to tube 110 and thence to the appropriate bin. If, however, the measured mass of the product of capsule 60B is less than that of the predetermined range, rotary solenoid 98A is energized so that the capsule 60B is diverted by blades 102A and 104A from the tube 62 to the tube 108 to the appropriate bin. Finally, if the measured mass of the product of capsule 60B is greater than the predetermined range, the rotary solenoid 98A remains deenergized, while the rotary solenoid 98B is energized. Thus the capsule 60B is diverted by the blades 102B and 104B from the tube 106 to the tube 112.

FIG. 5 shows that a carousel-type conveyor 58 which may be used to convey the products sequentially to point 18. Briefly, carousel assembly 58 comprises a rotatable turntable, shown generally at 120 having a plurality of means, shown schematically at 122, each for holding a capsule. Means 122 may be any type of device known in the art, such as shown in U.S. Pat. No. 3,366,236 issued to Breazeale on Jan. 30, 1968 for Classifying and Sorting by Density, wherein the means comprises a ferrule for holding the article by vacuum to the periphery of the turntable. As the turntable rotates, the articles may be fed through a suitable feed mechanism, shown schematically at 124, which can be any type of feed mechanism known in the art. The turntable 120 may be operated so that it moves at a constant rotational speed so that capsules pass one at a time through inspection point 18 at preselected time intervals. Alternatively, the turntable may be operated so that it rotates intermittently and indexes a new capsule into position 18, each time it is operated.

As the turntable 120 rotates, the capsules positioned by means 122 will rotate until they each reach the point 18 where the light beam 88 is broken, thereby briefly energizing the radiation source 22 to provide the radiation beam 34. The radiation beam 34 substantially instantaneously irradiates the entire bulk of the capsule 60B at point 18 and radiation scattered by the capsule is measured by the detector 26. This output electrical signal of detector 26 is processed by the control circuit 90 so that the mass of each product is measured and the product sorted by any suitable means, schematically shown at 126, which can be any type of sorting system known in the art and, for example, can include a sorter similar to sorter 92, previously described with reference to FIG. 3, or can include chutes as described in U.S. Pat. No. 3,366,236.

Figure 6:
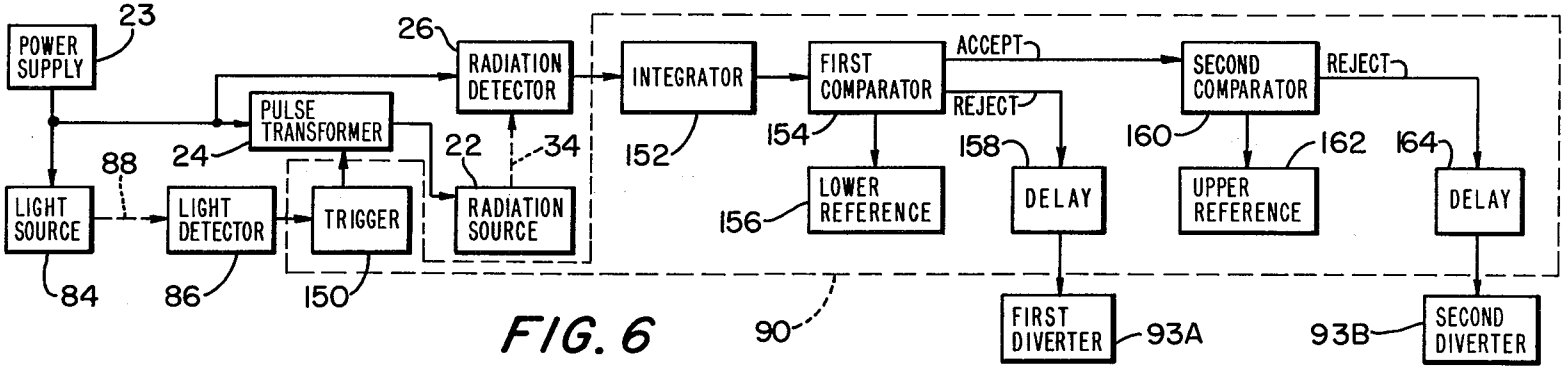
FIG. 6 is a block diagram of a complete system embodying the present invention.

Referring now to FIG. 6, the controls 90 comprise the circuits demonstrated within the dotted line. In FIG. 6, power supply 23 is connected to the pulse transformer 24, radiation detector 26 and light source 84. Light detector 86, coupled to the light source 84 by the beam 88, provides an output to a trigger circuit 150. The output of trigger circuit 150 is connected to pulse transformer 24 which in turn is connected to radiation source 22. Trigger circuits are well known to those skilled in the art and trigger circuit 150 operates such that when beam 88 is broken and detector 86 provides an output to the trigger the latter will provide an output pulse to the transformer 24 which causes source 22 to energize briefly, whereby a beam 34 is generated for a brief time, e.g., 5 milliseconds. Detector 26 detects radiation scattered by the capsule positioned at point 18. The detector 26 preferably operates in a current mode and hence will provide a current output which contains energy the magnitude of which is indicative of the mass of the measured capsule positioned at point 18. In a manner well known in the art, this current output signal is passed to an integrator 152 and integrated to provide a signal whose magnitude represents the amount of radiation energy received by detector 26 and thus a measure of the mass of the capsule. Integrators are well known in the art and thus will not be described in detail. For example, the integrator can include an RC circuit in which the amount of energy in the output signal from detector 26 is stored in a capacitor and this amount of energy is measured in the form of a voltage. The signal output of integrator 152 is connected to the input of a first comparator 154. This signal is compared to a lower reference signal provided by a lower reference source 156. The lower reference signal is representative of the lower limit of the range of acceptable masses and also of the mass of the environmental structure exposed by beam 34, i.e., the position of transport tube assembly 56 (or the portion of the carousel assembly 58) exposed to the beam 34 as well as the average mass of each container in which the product mass being measured is contained for example, the mass of a gelatin capsule in an empty state. This lower reference signal is generated in a suitable manner, e.g. by dropping off a suitable voltage or current from a variable voltage or current divider network, and its end is set to equal the level of the output of integrator 152 resulting from irradiating an empty product container at point 18 with beam 34.

If the magnitude of the signal provided by integrator 152 is less than the lower reference signal the output of the first comparator 154 is a reject signal. If, however, the signal provided by integrator 152 is equal to or above the lower reference signal the output of the first comparator is an accept signal. The reject signal is transmitted through a delay 158 to the rotary solenoid 98A of the first diverter 93A. This signal energizes the solenoid so that the blades 102A and 104A are moved to the second position being shown in dotted lines in FIG. 3. The delay introduced by the delay circuit 158 is sufficient to assure that the blades 102A and 104A are in the second position as the capsule falls through the first diverter 93A. This results in the capsule falling from the tube 62 through the casing 94A down the tube 108 to the appropriate bin which receives all capsules in which the measured mass is below the predetermined limit.

If the first comparator 154 provides an accept signal, solenoid 98A remains unenergized and the blades 102A and 104A remain in the first position. Therefore, the capsule will pass from the tube 62 through the casing 94A into the tube 106. The accept signal is transmitted to a second comparator 160. The second comparator 160 compares the accept signal input with an upper reference signal from an upper reference signal source 162. The upper reference signal provided by source 162 is representative of the mass of the environmental structure exposed by the beam 34, as previously described and also the upper limit of the range of acceptable masses. If the magnitude of the accept input signal to the second comparator 160 is above the upper reference signal, comparator 160 will provide a reject output signal through a delay 164 to the rotary solenoid 98B of the second diverter 93B. When the solenoid 98B is energized, the blades 102B and 104B are moved to the second position shown in dotted lines in FIG. 3, so that the measured capsule falling through the tube 106 will pass through the diverter 93A and out the tube 112 to the appropriate bin containing those capsules in which the mass of the measured product is excessive, i.e. above upper limit of the range of acceptable masses. The delay circuit 164 is designed to energize the rotary solenoid 98B just before the measured capsule passes through the second diverter 93B.

On the other hand, if the accept signal input to the second comparator 160 is below the upper reference signal provided by the source 162 no output signal is provided and the rotary solenoid 98B remains unenergized. Consequently, blades 102B and 104B will remain as shown in full lines in FIG. 3 so that capsules passing along the tube 106 will pass through the casing 98B and out tube 110 to a bin receiving capsules in which the measured mass is within the predetermined limits.

As is obvious from the foregoing description to a person skilled in the art, the present invention is capable of quickly and accurately measuring the mass of various products, particularly medicinal products such as capsules and tablets. It has been found that medicinal capsules can be tested at the rate of up to 20 per second utilizing the concepts of the present invention. Further, the invention has the advantage that a low energy source can be utilized without interferring with the personnel in the area as well as the products being tested. It has been determined that a capsule measuring system as herein described should comprise an X-ray tube operating at from about 40 to about 80 kilovolts peak (KVP). A lower X-ray tube kilovoltage will result in the capsule self-absorbing the scattered radiation, while at too high a voltage the radiation will tend to pass through the product and hence insufficient scattering will result.

Other advantages and possible modifications of the invention can be made without departing from the invention. For example, when the source of radiation 22 is of the type which includes a radioactive material, such as Americum 241 or Cobalt 157, the pulse transformer 24 can be omitted and means, such as shutter mechanism, can be used to intercept beam 34 in order to prevent the beam from continuously passing through point 18 and for insuring that the beam 34 exposes a product at point 18 for only a predetermined period of time.

Similarly, a continous beam could be used and the detector turned on for a predetermined period of time in synchronism with movement of the capsules through the point 18.

Since certain other changes may be made in the above-described apparatus and method without departing from the scope of the invention herein involved, it is intended that all matter contained in the above-description or shown in the accompanying drawing shall be interpreted in an illustrative and not in a limiting sense.

What is claimed is:

1. A system for classifying products according to their mass, said system comprising in combination;

means for conveying products along a predetermined path through an inspection station;

irradiating means for directing a beam of low energy penetrating radiation transversely to said path so that the entire bulk of each product conveyed through said station is substantially instantaneously exposed to said beam of radiation;

detector means for receiving radiation scattered by the entire bulk of each product irradiated by said beam and generating an electrical signal representative of the amount of scattered radiation received by said detector means; and means coupled to said detector means for determining the mass of each product irradiated by said beam as a function of said electrical signal.

2. A system in accordance with claim 1 wherein said irradiating means includes an aperture for defining the shape of said beam so that said beam floods the entire bulk of said product.

3. A system in accordance with claim 1 wherein said means for conveying products includes means for indexing said products one at a time through said inspection station.

4. A system in accordance with claim 1 wherein said means for conveying products includes means for moving said products without stopping through said inspection station.

5. A system in accordance with claim 1 wherein said irradiating means and detector means are positioned at said inspection station.

6. A claim in accordance with claim 1 wherein said irradiating means includes a low energy source of said radiation.

7. A system in accordance with claim 6 wherein said source of radiation emits radiation in the X-ray region of the electromagnetic spectrum.

8. A system in accordance with claim 6 wherein said source of radiation emits gamma radiation.

9. A system in accordance with claim 1 wherein said detector means includes a photomultiplier tube.

10. A system in accordance with claim 9 wherein said detector means further includes means for collimating the radiation scattered by said bulk to said photomultiplier tube.

11. A system in accordance with claim 1 wherein said means for determining the mass includes means for determining whether said mass is within a predetermined range.

12. A system in accordance with claim 11 further including sorting means for sorting those products whose mass is within said predetermined range from those products whose mass is outside of said predetermined range.

13. A method of classifying products according to their mass, said method comprising the steps of:

conveying said products along a predetermined path through an inspection station;

directing a beam of low energy penetrating radiation transversely to said path at said inspection station so that the entire bulk of each product conveyed through said station is substantially instantaneously exposed to said beam of radiation;

detecting radiation scattered by the bulk of each of said products when said each product is irradiated by said beam;

generating an electrical signal representative of the scattered radiation detected; and determining the mass of each product irradiated by said beam as a function of said electrical signal.

14. A method in accordance with claim 13 wherein said beam is directed at said inspection station only when a product to be measured is at said inspection station.

15. A method in accordance with claim 13 wherein said beam of radiation is directed continuously at said inspection station, and further wherein said product is moved so as to be interrupted by said beam for a predetermined limited period of time.

16. A method in accordance with claim 13 further including the step of sorting those products whose measured mass is within a predetermined range from those products whose mass falls outside of said predetermined range.

17. A system for classifying and sorting products according to their mass, said system comprising:

means for conveying products along a predetermined path through an inspection station;

means disposed at said inspection station for directing a beam of low energy penetrating radiation transversely to said path so that the entire bulk of each of said products at said station is substantially instantaneously exposed to said beam of radiation;

detector means for receiving radiation scattered by each product when the latter is irradiated by said beam and for generating in response to said scattered radiation an output signal representative of the mass of the irrdiated product; and means for determining the mass of each of said irradiated products according to the magnitudes of the output signal produced in response to the radiation scattered by said each product.

18. A system for classifying products according to their mass, said system comprising, in combination:

means for conveying products, one at a time, along a predetermined path through an inspection station;

means for generating a first electrical signal when a product is located in said inspection station;

a housing;

a source of low energy penetrating radiation disposed within said housing;

a collimator positioned between said housing and said inspection station, said collimator including an aperture for defining the cross-sectional shape of a beam generated by said source responsively to said first electrical signal and passing said beam to said inspection station in a direction transverse to said path so that each product conveyed through the inspection station is substantially instantaneously exposed directly to said beam of radiation;

detector means, positioned relative to said inspection station, for receiving radiation scattered by the entire bulk of each product exposed by said beam at said inspection station and for generating a second electrical signal representative of the mass of said product exposed by said beam;

first comparator means for comparing said second electrical signal with a first reference signal representative of the lower limit of acceptable range of masses of said product and for providing an output indicative of whether said second electrical signal is above or below said first reference signal;

second comparator means for comparing said second electrical signal with a second reference signal representative of the upper limit of acceptable range of masses of said product and for providing an output indicative of whether said second electrical signal is above or below said second reference signal; and means responsive to the outputs of said first and second comparator means for indicating whether the mass of said product exposed by said beam is (1) below said acceptable range of masses of said products, (2) above said acceptable range of masses of said products, or (3) within said acceptable range of masses.

19. A system according to claim 18 wherein said source of low energy penetrating radiation comprises an X-ray tube and means for energizing said X-ray tube in response to said first electrical signal.

20. A system according to claim 18, wherein said beam is directed along a predetermined axis and said detector means is offset from said axis.

21. A system according to claim 20, further including collimating means positioned with respect to said inspection station so as to pass radiation scattered from a product at said inspection station and arranged so as to prevent said detector means from being directly exposed to said beam.

22. A system for classifying individual products according to their mass, said system comprising, in combination;

means for conveying invidual products in series along a predetermined path through an inspection station;

irradiating means for directing a beam of low energy penetrating radiation along a predetermined axis transversely to said path so that the entire bulk of each product conveyed through said station is exposed substantially instantaneously to said beam of radiation;

signal generating means including detector means offset from said axis for receiving radiation scattered by the entire bulk of each product irradiated by said beam and generating an electrical signal representative of substantially only the amount of radiation scattered by each product and received by said detector means; and means coupled to said detector means for determining the mass of each product irradiated by said beam as a function of said electrical signal;

said system being adapted so that said electrical signal is produced only in response to radiation scattered when a product is positioned in said inspection station.

23. A system according to claim 22, further including means for operating said irradiation means so that said beam is generated only when a product to be measured is at said inspection station.

24. A system according to claim 22, further including collimating means positioned with respect to said inspection station so as to pass radiation scattered from a product at said inspection station and arranged so as to prevent said detector means from being directly exposed to said beam.

* * * * *

UNITED STATES PATENT OFFICE

CERTIFICATE OF CORRECTION

PATENT NO. : 4117935

DATED : October 3, 1978

INVENTOR(S) : Carl Richardson et al

It is certified that error appears in the above-identified patent and that said Letters Patent are hereby corrected as shown below:

Claim 17, line 2, column 11, the word "irrdiated" should be -- irradiated --.

Claim 22, line 17, column 12, the word "invidual" should be -- individual --.

Signed and Sealed this

*Ninth* Day of *January 1979*

[SEAL]

*Attest:*

RUTH C. MASON
*Attesting Officer*

DONALD W. BANNER
*Commissioner of Patents and Trademarks*